US011668529B2

(12) United States Patent
Manenti

(10) Patent No.: US 11,668,529 B2
(45) Date of Patent: Jun. 6, 2023

(54) DOUBLE-TUBE HEAT EXCHANGER AND MANUFACTURING METHOD THEREOF

(71) Applicant: Giovanni Manenti, Castelli Calepio (IT)

(72) Inventor: Giovanni Manenti, Castelli Calepio (IT)

( * ) Notice: Subject to any disclaimer, the term of this patent is extended or adjusted under 35 U.S.C. 154(b) by 193 days.

(21) Appl. No.: 17/047,891

(22) PCT Filed: Apr. 4, 2019

(86) PCT No.: PCT/IB2019/052755
§ 371 (c)(1),
(2) Date: Oct. 15, 2020

(87) PCT Pub. No.: WO2019/207384
PCT Pub. Date: Oct. 13, 2019

(65) Prior Publication Data

US 2021/0140714 A1 May 13, 2021

(30) Foreign Application Priority Data

Apr. 24, 2018 (IT) ..... 102018000004827

(51) Int. Cl.
*F28D 7/10* (2006.01)
*F28F 1/08* (2006.01)
*F28D 21/00* (2006.01)

(52) U.S. Cl.
CPC ..... *F28D 7/106* (2013.01); *F28F 1/08* (2013.01); *F28D 21/00* (2013.01);
(Continued)

(58) Field of Classification Search
CPC .. F28D 7/106; F28D 21/00; F28D 2021/0075; F28D 9/0246; F28D 9/0248;
(Continued)

(56) References Cited

U.S. PATENT DOCUMENTS 4,371,775 A 2/1983 Mihara et al.
5,579,831 A * 12/1996 Brucher ..... F28F 9/02 165/154

(Continued)

FOREIGN PATENT DOCUMENTS

DE 3009532 A1 9/1980
DE 202015101120 U1 3/2015

(Continued)

*Primary Examiner* — Harry E Arant
(74) *Attorney, Agent, or Firm* — Dickinson Wright PLLC; Andrew D. Dorisio

(57) ABSTRACT

A double-tube heat exchanger includes an outer tube and an inner tube forming a first annular gap. The outer tube is provided with an inlet connection and an outlet connection for inletting and outletting a first fluid flowing in the first annular gap. The inner tube includes a first inlet connection and a second outlet connection for inletting and outletting a second fluid flowing in the inner tube for an indirect heat exchange with the first fluid. One of the tube sections is integrally formed with an assembly wall which joints a first end of the outer tube to the inner tube, to seal the first annular gap at the first end of the outer tube. A second annular gap is exposed to the air and is in fluid communication neither with the first annular gap nor with the inner tube, and is partially surrounded by the first annular gap.

13 Claims, 13 Drawing Sheets

(52) U.S. Cl.
CPC .. *F28D 2021/0075* (2013.01); *F28F 2265/26* (2013.01); *F28F 2270/00* (2013.01)

(58) Field of Classification Search
CPC ..... F28D 9/182; F28D 9/185; F28D 9/187; F28D 9/0253; F28D 9/0256; F28D 7/10; F28D 7/12; F28F 1/08; F28F 2265/26; F28F 2270/00; F28F 2265/10; F28F 9/0246; F28F 9/0248; F28F 9/182; F28F 9/185; F28F 9/187; F28F 9/0253; F28F 9/0256
See application file for complete search history.

(56) References Cited

U.S. PATENT DOCUMENTS

| | | | | |
|---|---|---|---|---|
| 2005/0045315 | A1 | 3/2005 | Seager et al. | |
| 2005/0155748 | A1 | 7/2005 | Seager | |
| 2005/0178535 | A1* | 8/2005 | Ricci | F28D 7/106 165/154 |
| 2012/0318483 | A1* | 12/2012 | Cosby | F28D 21/0012 165/154 |

FOREIGN PATENT DOCUMENTS

| | | | | |
|---|---|---|---|---|
| DE | 202015101120 | U1 * | 4/2015 | F01N 3/02 |
| WO | 2016094971 | A1 | 6/2016 | |

* cited by examiner

DOUBLE-TUBE HEAT EXCHANGER AND MANUFACTURING METHOD THEREOF

FIELD OF THE INVENTION

The present invention refers to a double-tube heat exchanger for fast cooling, or quenching, of a fluid at high temperature by means of another fluid at high pressure, in boiling conditions or not, according to an indirect heat exchange. Specifically, this invention refers to a so-called "quencher" for hot gases discharged from hydrocarbons steam cracking furnaces for olefins production.

BACKGROUND

In some chemical processes, fluids discharged at high temperature from chemical reactors must be cooled in short time (fractions of second) so as to stop possible residual chemical reactions. Hot gases discharged from hydrocarbons steam cracking furnaces are an important example. Such gases are also called "cracked gases". The cracked gas is discharged from the furnace at a temperature of 800-850° C. and it must be rapidly cooled below 500° C. The cracked gas is laden of carbonaceous and waxy substances, which can be cause of significant deposits and erosion of heat exchanger parts. Industrial processes for carbon-black and vinyl-chloride-monomer (VCM) production are other processes where a rapid cooling of a high temperature and heavily fouled gas is required. Carbon-black gas is typically discharged from hydrocarbons combustor at a temperature higher than 1200° C. and it must be rapidly cooled by 300-400° C. at least. The VCM is discharged from the dichloroethane cracking furnace at a temperature of 500-600° C. about, and it must be rapidly cooled to 300° C. approx.

For accomplishing an indirect and rapid cooling of a process fluid under severe operating conditions, a double-tube heat exchanger, or a double-tube quencher, is a preferred solution. A double-tube quencher mainly consists of two tubes concentrically arranged. Usually, the hot and fouled fluid flows in the inner tube, whereas the cooling fluid flows in the annular gap, or in the annulus, formed in between the outer and inner tube. Each tube is provided with its inlet and outlet connections for the continuous circulation of the fluids. The fluids can exchange heat, with no direct contact between them, according to a counter- or co-current configuration.

A double-tube heat exchanger offers important technological advantages for quenching operations. First, the velocity of the cooling fluid flowing in the annular gap between the two tubes is high and uniform for the most portion of the gap, therefore reducing low-velocity or dead zones. This guarantees a high heat transfer coefficient outside the inner tube. Consequently, operating metal temperature and thermal-mechanical stresses of the inner tube can be lessened. Typically, for the cracked gas service, high-pressure (4000-13000 kPa) and boiling water is used as a cooling fluid, with a velocity in the annular gap higher than 1 m/s; the highest operating metal temperature of the inner tube, wherein the hot cracked gas flows, is around 390-420° C. averaged across thickness.

Another advantage of a double-tube heat exchanger arises from high velocities that can be obtained in the inner tube. Since the inner tube has no significant discontinuities or obstructions along the tube length, the fluid has no impingement points. Consequently, erosion and fouling deposit can be reduced or eliminated. Moreover, high velocities lead to high heat transfer coefficients, necessary for a rapid cooling. Finally, due to the simple tubular geometry, the inner tube can be cleaned by a mechanical method with no difficulties. Therefore, a process fluid with heavy fouling can be allocated in the inner tube.

Several technological solutions for double-tube heat exchangers have been proposed. Some of them are here below recalled. Document US 2005/155748 A1describes a heat exchanger, for the indirect heat exchange between two fluids, wherein the gap in between the outer and inner tube is closed by a sealing member installed at the ends of the exchanger and inside the gap. The sealing member is a distinct item from the outer and inner tube, and essentially consists of two walls, generally axially extending, jointed together for preferably forming a "V" or "U" or "H" profile. One of the walls seals to the internal surface of the outer tube, whereas the other wall seals to the external surface of the inner tube. The sealing occurs by friction, contact or, preferably, angle or fillet brazing. Such a heat exchanger is not suitable for the cracked gas quenching service, where high pressure and boiling water flows in the gap in between the outer and inner tube: the sealing between the pressure parts is structurally weak, the crevice between the sealing member and the inner tube can lead to a crevice-corrosion and the welding joint type cannot guarantee a full penetration and an accurate non-destructive examination.

Document DE 3009532 A1 describes a heat transfer device comprising a tubular shell, two walls closing the shell at the ends, wherein one wall is provided with a connection for flowing a first fluid, a central opening with a tubular element for each wall for flowing the first fluid, and a partition, internal to the shell, which extends for the length of the shell. The internal partition has no tubular configuration and therefore it splits the volume of the shell into two compartments that are not concentrically arranged. A first compartment of the shell is in communication with the connection installed on the closing wall and the second compartment is in communication with the central openings. The two compartments are each other in fluid communication by means of slots installed at the internal partition; consequently, the two compartments of the tubular shell are not configured for an indirect heat transfer between two fluids.

Following documents, specifically, refer to double-tube heat transfer devices for an indirect heat exchange between cracked gas and cooling water. In document U.S. Pat. No. 3,583,476 A the inner tube receives the cracked gas and the outer tube forms a cooling chamber between the inner and the outer tube. The cooling water, coming from a steam drum at elevated position, circulates in the cooling chamber. In order to attenuate differential thermal elongations between inner and outer tube, the device according to U.S. Pat. No. 3,583,476 A is characterized by an inner tube consisting of two sections where each one is fixed at one end and is free to slide at the other end. The crevice formed in between the two sliding portions is sealed by a steam injection. Therefore, such a device is mainly aimed to solve out the critical issue of thermal-mechanical stresses due to the differential thermal elongations between the inner and outer tube.

Document U.S. Pat. No. 4,457,364 A describes a device comprising a heat exchange bundle of double-tube elements. Each element consists of an outer and an inner tube, concentrically arranged, where the cracked gas and the cooling water, respectively, flow in the inner tube and in the annular gap. The terminal part of each double-tube element is provided with an oval or pseudo-oval manifold for the water, in fluid communication with the annular gap.

Document U.S. Pat. No. 5,690,168 A describes the terminal transition portion of a double-tube heat exchanger. The terminal portion is characterized by an annular gap formed in between an internal sleeve and an external wall. The annular gap is filled-in with a refractory material for protecting the external wall from high temperature. The annular gap is provided, at one end, with a transition cone jointed to the inlet portion of the cracked gas and, at the other end, with a closing ring jointed the outer tube.

Document US 2007/193729 A1 describes the transition portion of the outlet end of a double-tube heat exchanger. Such an outlet transition, of conical shape, is provided with mounting inner and outer elements forming an annular gap in between. The annular gap is filled-in with insulating material (refractory) for reducing the operating metal temperature of the mounting outer element.

Another terminal transition portion of a double-tube heat exchanger for quenching a cracked gas is described in document U.S. Pat. No. 7,287,578 B2. The cooling water flows in the outer tube and the cracked gas flows in the inner tube. The inner and outer tubes are each other connected, at their respective ends, by means of a connecting element which has a fork shape. Such a connecting element closes the terminal portion of the annular gap formed in between the inner and outer tube. The inlet connection, or the outlet connection, of the outer tube is directly jointed to the connecting element, so as to efficiently cool such element.

In all the cited documents, the most critical parameters of a cracked gas quencher of double-tube type are: (a) the operating metal temperatures of the elements jointing the outer and inner tube, and (b) the thermal-mechanical stresses arising from thermal gradients in pressure parts and differential thermal elongations between the outer and inner tube. The cited technological solutions have both advantages, both potential disadvantages. The steam injection in the inner tube makes complex the design due to the relevant inlet and outlet steam chambers and to the need for a continuous steam flow. The refractory lining can undergo a decay of chemical and mechanical properties along the service and, at worst, can deposit salts on the hot walls with consequent corrosion. The sleeves installed on the inner tube side can present a risk of deformation due to heavy fouling, severe and cyclic operating conditions.

From a general point of view, the abovementioned process fluids, by example the cracked gas and the carbon-black gas, are at so high temperature that the operating metal temperature of the inner tube can lead to corrosion and overheating, with consequent risk of localized damages. Moreover, in case the cooling fluid is high-pressure boiling water, two additional critical issues arise. First, salts and metal oxides dispersed in the water can deposit on pressure parts, at inlet of the hot fluid, leading to rapid damages due to corrosion and overheating. Then, high thermal fluxes typical of the boiling water can induce a steam blanketing condition with consequent overheating.

According to a preferred configuration of double-tube quencher, the hot fluid flows in the inner tube. Therefore, the inner tube is in contact with both the hot fluid and the cold fluid, whereas the outer tube is in contact with the cold fluid only. Therefore, the two tubes operate at different metal temperatures, which means that the tubes undergo different thermal elongations, both in radial and longitudinal direction. Thus, the design of a double-tube quencher should be aimed to absorb the differential thermal elongations of the two tubes. For heavily fouled fluids, like cracked and carbon-black gas, operations are often shut-down for cleaning. Therefore, the double-tube quencher also undergoes several temperature and pressure cycles.

As per above, the most critical parts of a double-tube heat exchanger for quenching a process fluid at high temperature are the terminal portions and, more specifically, the connecting elements between the inner and outer tube. The hot terminal portion, where the hot fluid enters, is characterized by the highest temperatures and velocities, as well as the highest thermal fluxes and gradients. In summary then, critical items of a double-tube quencher can suffer from:

a) overheating,
b) corrosion,
c) erosion,
d) high thermal-mechanical stresses,
e) thermal chocks,
f) cycling service.

A smart configuration of the terminal portions, specifically of the elements jointing the inner and outer tube, can extend operating life and improve reliability of a double-tube quencher. In particular, the design of a steam cracking furnace quencher should target to:

- eliminate or reduce hot spots on the inner tube walls and on the elements jointing inner and outer tubes;
- eliminate or reduce impurities deposits on water-side heat transfer surfaces;
- eliminate or reduce low-velocities zones, re-circulation zones, and steam engulfment on water-side heat transfer surfaces;
- eliminate or reduce localized impingements and thermal shocks;
- attenuate thermal gradients in pressure parts;
- absorb the differential thermal elongations.

SUMMARY

An object of the present invention is therefore to provide a double-tube heat exchanger which solves the potential issues of the aforementioned prior-art in a simple, economic and particularly functional manner.

In detail, an object of the present invention is to provide a double-tube heat exchanger with extended operating life and improved reliability by means of an alternative design with respect to known technological solutions. More specifically, the present invention refers to, but is not limited to, an innovative quencher for hydrocarbons steam cracking furnaces for olefins productions. Such an object is achieved by means of an innovative configuration of a double-tube heat exchanger which can, at least partially, achieve the aforementioned targets.

Another object of the present invention is to provide a manufacturing method of a double-tube heat exchanger.

Such objects according to the present invention are achieved by providing a double-tube heat exchanger and a manufacturing method thereof as disclosed in the independent claims.

BRIEF DESCRIPTION OF THE DRAWING FIGURES

Further features and advantages of a double-tube heat exchanger in accordance with the present invention shall be better elucidated by following exemplifying and non-exhaustive description, referred to the attached illustrative drawings, wherein.

DETAILED DESCRIPTION

It is underlined that, in all the attached illustrative drawings, identical reference numbers correspond to identical elements or to elements that are one other equivalent.

Figure 1:
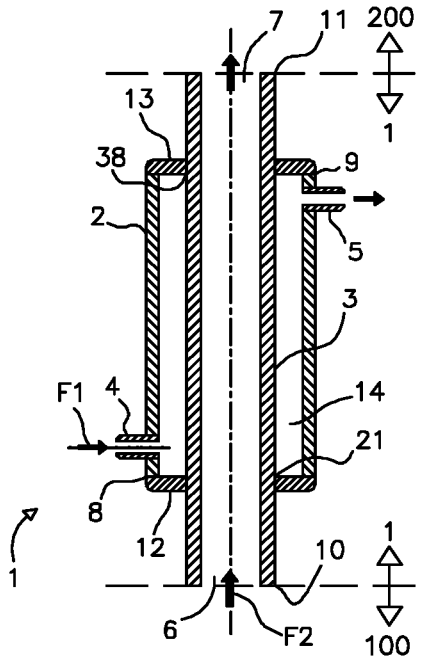
Fig.1 (Prior art)
FIG. 1 is a sectional longitudinal view of a double-tube heat exchanger according to the prior-art.

With reference to FIG. 1, a double-tube heat exchanger according to the prior-art, wholly indicated with reference number 1, is shown. Layout of the heat exchanger 1 can be vertical, horizontal or any other. The heat exchanger 1 comprises an outer tube 2 and an inner tube 3, concentrically arranged so as to form a first annular gap 14, or a first annulus, in between such an outer tube 2 and such an inner tube 3. The outer tube 2 is provided with at least a first connection 4 and at least a second connection 5 for inletting and outletting, respectively, a first fluid F1. Each connection 4 and 5 of the outer tube 2 is preferably located near a respective end 8 and 9 of such an outer tube 2. The inner tube 3 is in turn provided with at least a first connection 6 and at least a second connection 7 for inletting and outletting, respectively, a second fluid F2. Each connection 6 and 7 of the inner tube 3 is preferably located near a respective end 10 and 11 of the inner tube 3 and is jointed to equipment, or conduits, installed on upstream side 100 and/or on downstream side 200 of the heat exchanger 1. The two fluids F1 and F2 are indirectly contacted for the heat transfer, by means of co-current or counter-current configuration. Consequently, flows direction of the first fluid F1 and of the second fluid F2 can be different with respect to what shown in FIG. 1. The inner tube 3 and the outer tube 2 are jointed by means of a first assembly wall 12 and a second assembly wall 13. The first assembly wall 12 joints the first end 8 of the outer tube 2 to the inner tube 3 in a first point 21 located in between the two connections 6 and 7 of the inner tube 3. The second assembly wall 13 joints the second end 9 of the outer tube 2 to the inner tube 3 in a second point 38 located as well in between the two connections 6 and 7 of the inner tube 3. The two assembly walls 12 and 13 seal the first annulus 14 at the two ends.

As shown in FIG. 1, which illustrates one of the possible operating modes of the heat exchanger 1, the first fluid F1 enters the first annulus 14 thru the first connection 4, it flows along the first annulus 14 and then it exits the first annulus 14 thru the second connections 5. The second fluid F2 enters the inner tube 3 thru the first connection 6, it flows along the inner tube 3 and then it exits the inner tube 3 thru the second connection 7. The two fluids F1 and F2 indirectly exchange heat each other thru the wall of the inner tube 3 which is in direct contact with the first fluid F1.

Figure 2A:
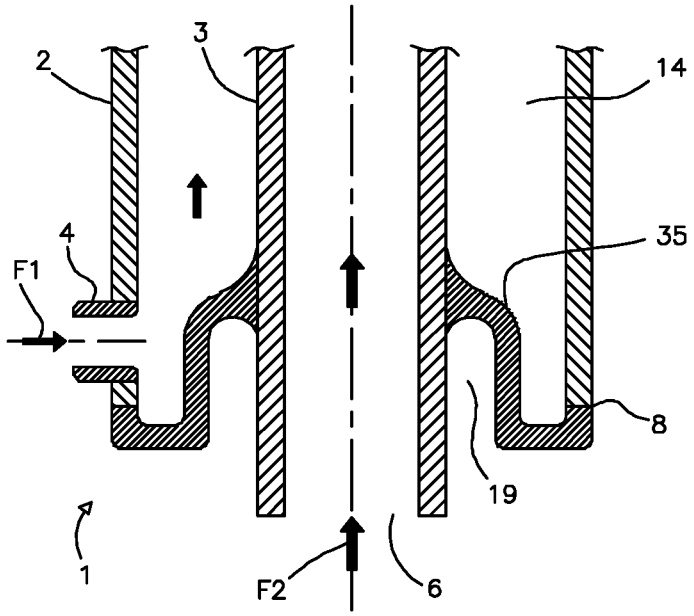
Fig.2A (Prior art)
FIGS. 2A, 3A and 4A are a partial and sectional longitudinal view of a double-tube heat exchanger according to the prior-art.
Figure 3A:
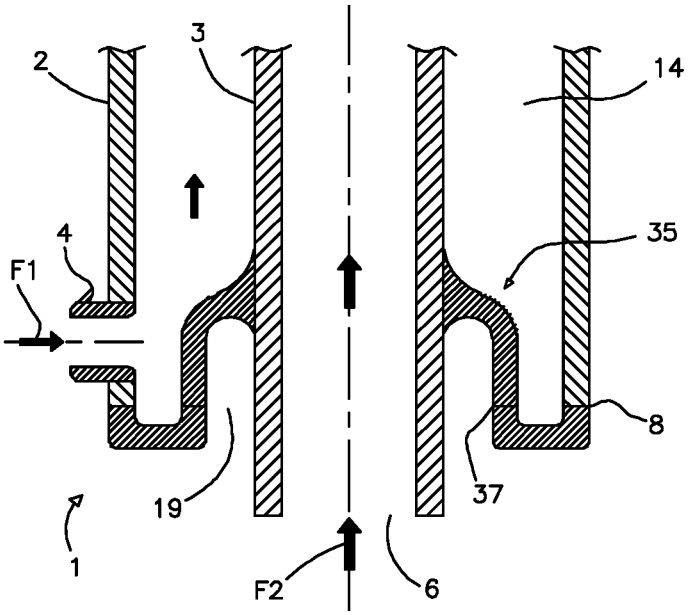
Fig.3A (Prior art)
Figure 4A:
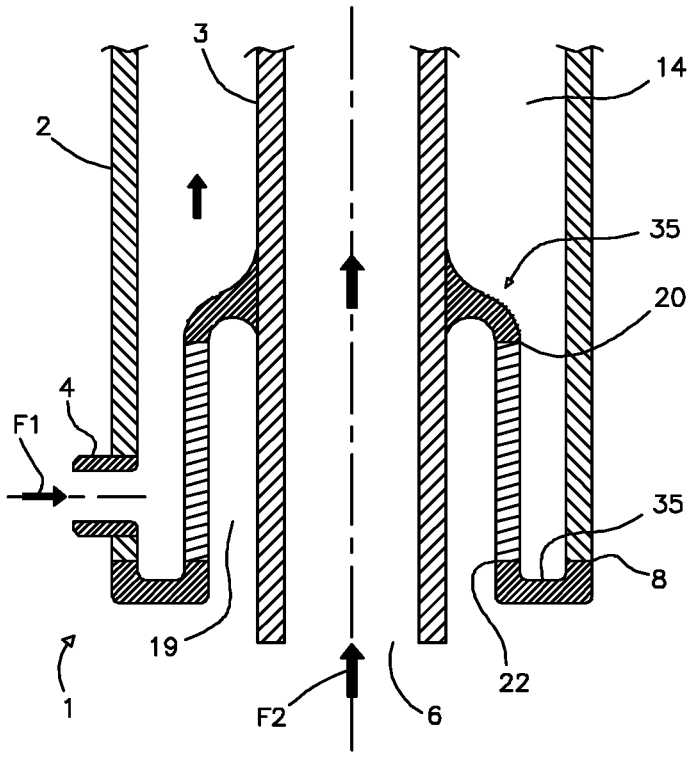
Fig.4A (Prior art)

With reference to FIGS. 2A, 3A and 4A, some possible embodiments of the double-tube heat exchanger 1 according to the prior-art (in particular according to document US 2005/155748 A1), are shown. More specifically, FIGS. 2A, 3A and 4A show a terminal portion of the heat exchanger 1. The heat exchanger 1 is provided with an outer tube 2 and an inner tube 3 concentrically arranged so as to form a first annular gap 14, or a first annulus. The outer tube 2 is provided with at least a first connection 4 and with at least a second connection (not shown in the figures, but comparable to the second connection 5 of FIG. 1) for inletting and outletting, respectively, a first fluid F1. The inner tube 3 is in turn provided with at least a first connection 6 and with at least a second connection (not shown in the figures, but comparable to the second connection 7 of FIG. 1) for inletting and outletting, respectively, a second fluid F2.

The outer tube 2 is jointed, at a first end 8 thereof, to the inner tube 3 in a point located between the inlet connection 6 and the outlet connection 7 of the inner tube 3. The joining between the outer tube 2 and the inner tube 3 is obtained by means of an assembly wall 35 which seals the terminal portion of the first annulus 14. The assembly wall 35 forms a second annular gap 19, or a second annulus, exposed to the air and substantially pocket-shaped. The assembly wall 35 can be formed by a single element (FIG. 2A) or by a plurality of elements (FIGS. 3A and 4A) jointed together by joints 37, 20, 22.

The assembly wall 35 is a distinct element with respect to the outer tube 2 and the inner tube 3. The assembly wall 35 is not in direct contact with the second fluid F2 and is jointed to the external surface of the inner tube 3 by contact, friction or, preferably, angle/fillet welding joint. Such a joint, however, is not recommended in case of high-pressure cooling water in boiling conditions and of high metal temperatures, typical of cracked gas quenchers, since this joint cannot guarantee accurate non-destructive examinations and can lead to crevice corrosion, leakage, high local thermal-mechanical stresses and aging along time.

Figure 2B:
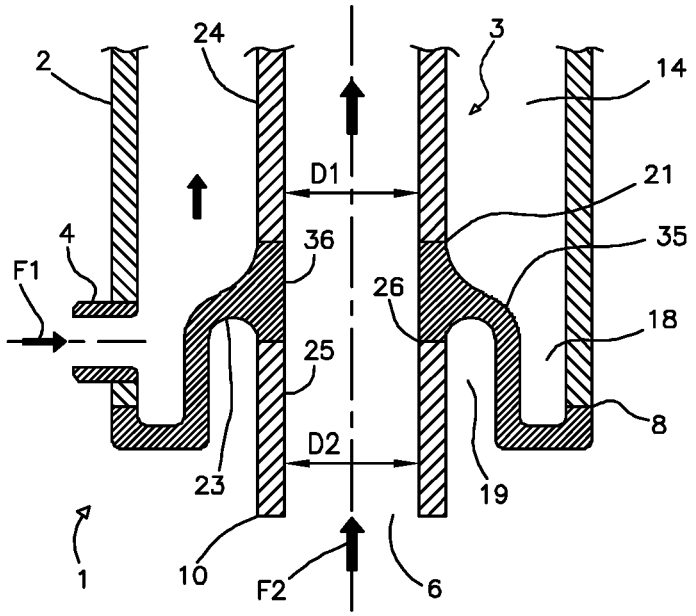
FIG. 2B is a partial and sectional longitudinal view of a first embodiment of the double-tube heat exchanger according to the invention.

With reference to FIG. 2B, a first embodiment of the double-tube heat exchanger 1 according to the invention is shown. More specifically, FIG. 2B shows a terminal portion of the heat exchanger 1. The heat exchanger 1, in a known way, is provided with an outer tube 2 and with an inner tube 3 concentrically arranged so as to form a first annular gap 14, or a first annulus, in between them. The outer tube 2 is provided with at least a first connection 4 and with at least a second connection (not shown in FIG. 2B, but comparable to the second connection 5 of FIG. 1) for inletting and outletting, respectively, a first fluid F1. The inner tube 3 is provided with at least a first connection 6 and with at least a second connection (not shown in FIG. 2B, but comparable to the second connection 7 of FIG. 1) for inletting and outletting, respectively, a second fluid F2. Each connection 6 and 7 of the inner tube 3 is jointed to equipment, or conduits, installed on upstream side 100 and/or on downstream side 200 of the heat exchanger 1. The portion of the heat exchanger 1 illustrated in FIG. 2B shows only the inlet connection 4 of the outer tube 2 and the inlet connection 6 of the inner tube 3.

As shown in FIG. 2B, the first fluid F1 and the second fluid F2 flow, respectively, in the first annulus 14 and in the inner tube 3 essentially with a co-current configuration. However, the flows direction of two fluids F1 and F2 can be different than that of FIG. 2B. For example, the two fluids F1 and F2 can flow according to a counter-current configuration. In other words, the inlet connection 4 of the outer tube 2, as in FIG. 2B, can be swapped with the outlet connection, keeping unchanged the flow direction of the second fluid F2 in the inner tube 3. Alternatively, the inlet connection 6 of the inner tube 3, as in FIG. 2B, can be swapped with the outlet connection, keeping unchanged the flow direction of the first fluid F1 in the outer tube 2.

According to the invention, the inner tube 3 is formed by at least two tube sections 24, 25, 36 jointed each other by means of a joint of butt-to-butt type, for instance a welding joint of butt-to-butt type. At least one of the two tube sections 25, 36 is integrally formed, as a single monolithic piece, with the assembly wall 35.

The embodiment illustrated in FIG. 2B shows three tube sections of the inner tube 3, that is a first tube section 24, a second tube section 25 and a third tube section 36. The third tube section 36 is integrally formed with the assembly wall 35. In other words, the third tube section 36 of the inner tube 3 and the assembly wall 35 are all-in-one-piece made. Consequently, the assembly wall 35 is not a distinct element with respect to the inner tube 3, contrarily to the embodiments given in FIGS. 2A, 3A and 4A and described in the document US 2005/155748 A1. The first tube section 24 and the second tube section 25 are jointed by means of the third tube section 36, which is installed in between the first tube section 24 and the second tube section 25. The first end 21 of the first tube section 24 is jointed to the third tube section 36, whereas the second end (not shown) of the first tube section 24 is located towards the outlet connection 7 of the inner tube 3. The first end 10 of the second tube section 25 corresponds to the inlet connection 6 of the inner tube 3, whereas the second end 26 of the second tube section 25 is jointed to the third tube section 36. The junctions between the tube sections 24, 36 and 25, at the respective ends 21 and 26, correspond to joints of butt-to-butt type, for instance welding joints of butt-to-butt type and of full penetration type.

The outer tube 2 is jointed, at a first end 8 thereof, to the inner tube 3 by means of the assembly wall 35 which seals the terminal portion of the first annulus 14.

According to the invention, the assembly wall 35 forms a second annular gap 19, or a second annulus, exposed to the air and substantially pocket-shaped. In other words, a first annular end of the second annulus 19 is closed by the assembly wall 35, whereas the opposite annular end of the second annulus 19 is opened to the air. In the second annulus 19, therefore, neither the first fluid F1 nor the second fluid F2 flows since such a second annulus 19 is facing the external surface of the heat exchanger 1.

The following features are therefore combined in the heat exchanger 1 of the present invention:

- two or more tube sections 24, 25, 36 of the inner tube 3 are reciprocally jointed by means of respective joints of butt-to-butt type,
- at least one of the tube sections 24, 25, 36 is integrally formed, as a single monolithic piece, with the assembly wall 35, and
- the second annulus 19 exposed to the air is, at least partially, delimited by such assembly wall 35.

Such combined features allow to simultaneously obtain the following major advantages:

- the inner tube 3 can be provided with strength welding joints of high quality and suitable for high pressure and high temperature services, since such welding joints can be examined by radiographic (RT) and ultrasonic (UT) testing;
- welding joints related to the inner tube 3 are of full penetration type, therefore capable of preventing crevice corrosion, and are free from bevels discontinuities, therefore capable of preventing localized impingement of the fluids;
- the tube section of the inner tube 3 and the assembly wall 35, that are integrally formed as single piece, are the most critical item for the heat exchanger 1. This item can be manufactured by forging or casting, and therefore according to a high-level manufacturing quality due to uniform chemical and mechanical properties;
- conformation of assembly wall 35 and second annulus 19 enhances the structural flexibility of the heat exchanger 1, so as to efficaciously absorb the differential thermal elongations along radial and longitudinal direction between the outer tube 2 and the inner tube 3;
- depending on the service of the double-tube heat exchanger 1, the assembly wall 35 and second annulus 19 allow reducing or preventing stagnation zones and/or impurities deposit on the assembly wall 35, near the inner tube 3, on the first annulus 14 side.

The second annulus 19 can be interposed between the inner tube 3, or the upstream 100 or the downstream 200 equipment, or the inner tube 3 and the upstream 100 or the downstream 200 equipment, and the assembly wall 35. If the first end 10 of the inner tube 3 is placed inside the second annulus 19, a portion of such a second annulus 19 results to be delimited by the assembly wall 35 and the upstream 100 or downstream 200 equipment jointed to the first end 10 of the inner tube 3. The second end 26 of the second tube section 25, jointed to the third tube section 36, can be placed inside or outside with respect to the second annulus 19 exposed to the air. The second annulus 19 is in fluid communication neither with the first annulus 14 nor with the inner tube 3; the second annulus 19 is, at least partially, surrounded by the first annulus 14. The specific portion of the first annulus 14 that surrounds the second annulus 19 can be considered as an additional annulus 18. Such an additional annulus 18 is in fluid communication with the first annulus 14. In other words, the additional annulus 18 is an integral part of the first annulus 14. The terminal portion 23 of the second annulus 19, that is the portion closed by the assembly wall 35, has preferably a convex shape, or a "U" shape, facing the second annulus 19. The first end 10 of the inner tube 3, corresponding to the inlet connection 6 of the inner tube 3, can be placed inside or outside the second annulus 19. In FIG. 2B, the first end 10 of the inner tube 3 is shown outside the second annulus 19.

The profile of the assembly wall 35 that faces the first annulus 14 and that is next to the junction 21 of the inner tube 3 is preferably curvilinear and with a continuous slope towards the additional annulus 18. The tube section 36 of the inner tube 3, integrally formed with the assembly wall 35, preferably consists of a metallic piece made by forging or casting, made in carbon steel, low alloy steel or nickel alloy for high temperatures.

The inlet connection 4 of the outer tube 2 is preferably installed on the outer tube 2. Alternatively, the inlet connection 4 of the outer tube 2 can be installed on the assembly wall 35 or on both the assembly wall 35 and the outer tube 2. According to an advantageous configuration of the heat exchanger 1, the inlet connection 4 of the outer tube 2 is installed at the additional annulus 18.

The inner tube 3 can have either a uniform or non-uniform internal diameter. For example, the inner tube 3 can have at least two different internal diameters D1 and D2. As per a possible configuration of the heat exchanger 1, the second tube section 25 and the third tube section 36 can have an internal diameter D2 which is different than the internal diameter D1 of the first tube section 24 of the inner tube 3.

Figure 2C:
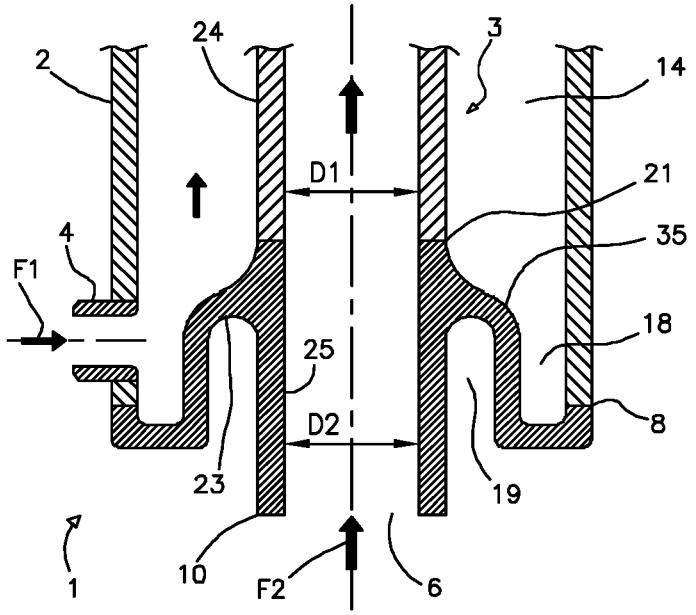
FIG. 2C is a partial and sectional longitudinal view of a second embodiment of the double-tube heat exchanger according to the invention.

With reference to FIG. 2C, a second embodiment of the double-tube heat exchanger 1 according to the invention is shown. More specifically, FIG. 2C shows a terminal portion of the heat exchanger 1. The heat exchanger 1 of FIG. 2C is essentially identical to the one shown in FIG. 2B, except for the inner tube 3. Two tube sections of the inner tube 3 are shown, that is a first tube section 24 and a second tube section 25. The second tube section 25 is integrally formed with the assembly wall 35. In other words, the second tube section 25 of the inner tube 3 and the assembly wall 35 are all-in-one-piece made. Consequently, the assembly wall 35 is not a distinct element with respect to the inner tube 3, contrarily to the embodiments shown in FIGS. 2A, 3A and 4A and described in document US 2005/155748 A1. The first end 21 of the first tube section 24 is jointed to the second tube section 25, whereas the second end (not shown) of the first tube section 24 is located towards the outlet connection 7 of the inner tube 3. The junction between the tube sections 24 and 25, at the end 21, corresponds to a welding joint of butt-to-butt type and of full penetration type. The first end 10 of the inner tube 3, which corresponds to an end of the second tube section 25, can be placed inside or outside with respect to the second annulus 19 exposed to the air.

Figure 3B:
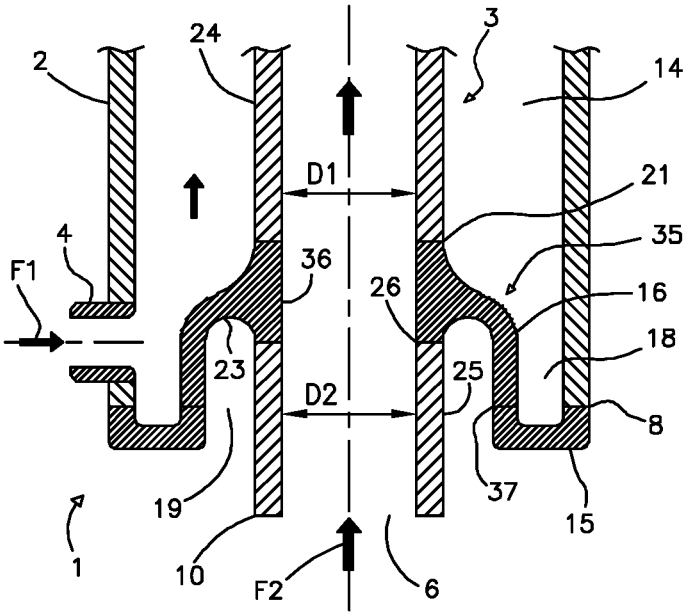
FIG. 3B is a partial and sectional longitudinal view of a third embodiment of the double-tube heat exchanger according to the invention.
Figure 3C:
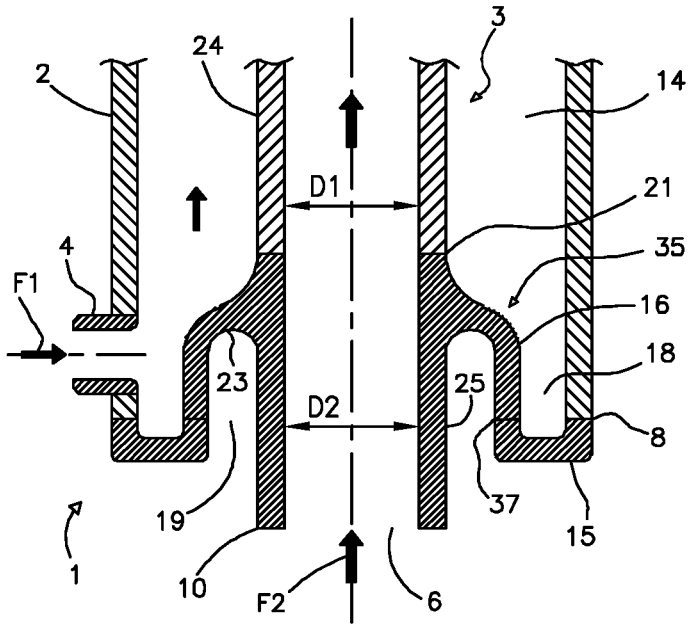
FIG. 3C is a partial and sectional longitudinal view of a fourth embodiment of the double-tube heat exchanger according to the invention.

With reference to FIGS. 3B and 3C, a third and a fourth embodiment of the double-tube heat exchanger 1 according to the invention are respectively shown. More specifically, FIGS. 3B and 3C show a terminal portion of the heat exchanger 1. The heat exchanger 1 of FIG. 3B is essentially identical to the one shown in FIG. 2B, except for the assembly wall 35 which comprises two assembly elements 15 and 16 jointed by an intermediate junction 37. The outer tube 2 is jointed, at a first end 8 thereof, to the first assembly element 15. The intermediate junction 37 between the first assembly element 15 and the second assembly element 16 is preferably placed in between the second annulus 19 exposed to the air and the additional annulus 18. The terminal portion 23 of the second annulus 19 is preferably delimited only by the second assembly element 16. The second assembly element 16 is integrally formed with the third tube section 36 of the inner tube 3. The first assembly element 15 and the second assembly element 16 are preferably metallic pieces made by forging or casting, made in carbon steel, low alloy steel or nickel alloy for high temperatures, and they can have any shape, for example curvilinear.

The heat exchanger 1 of FIG. 3C is essentially identical to the one shown in FIG. 2C, except for the assembly wall 35 which comprises two assembly elements 15 and 16 jointed by an intermediate junction 37. The outer tube 2 is jointed, at a first end 8 thereof, to the first assembly element 15. The intermediate junction 37 between the first assembly element 15 and the second assembly element 16 is preferably placed in between the second annulus 19 exposed to the air and the additional annulus 18. The terminal portion 23 of the second annulus 19 is preferably delimited only by the second assembly element 16. The second assembly element 16 is integrally formed with the second tube section 25 of the inner tube 3. The first assembly element 15 and the second assembly element 16 are preferably metallic pieces made by forging or casting, made in carbon steel, low alloy steel or nickel alloy for high temperatures, and they can have any shape, for example, curvilinear.

Figure 4B:
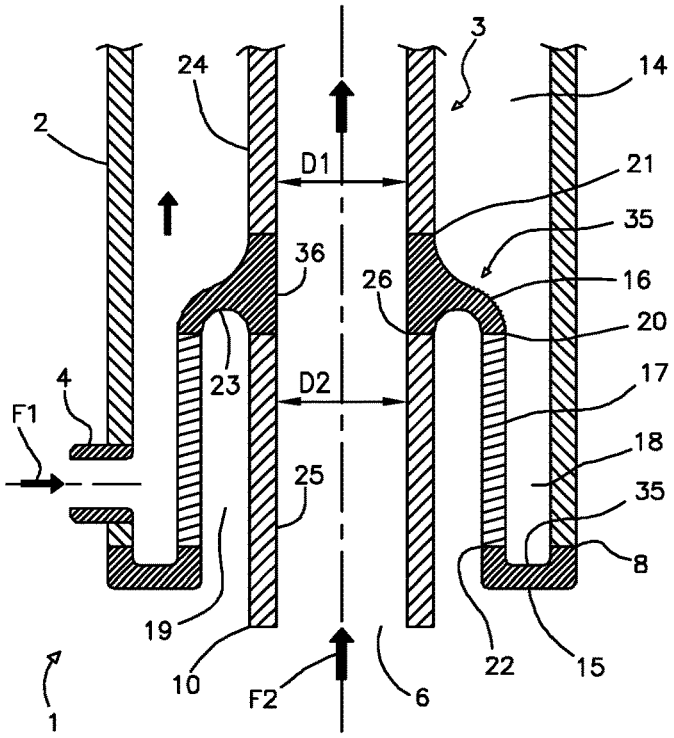
FIG. 4B is a partial and sectional longitudinal view of a fifth embodiment of the double-tube heat exchanger according to the invention.
Figure 4C:
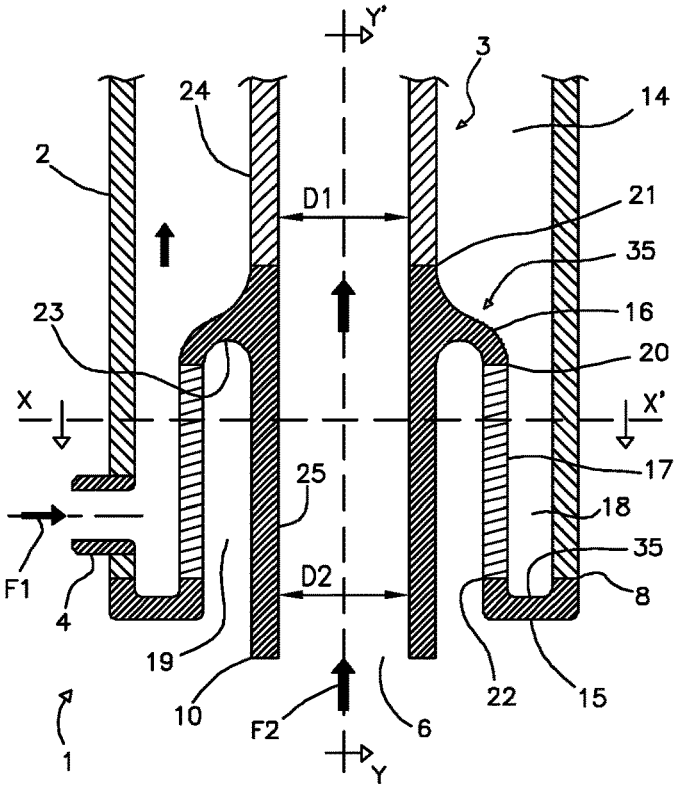
FIG. 4C is a partial and sectional longitudinal view of a sixth embodiment of the double-tube heat exchanger according to the invention.

With reference to FIGS. 4B and 4C, a fifth and a sixth embodiment of the double-tube heat exchanger 1 according to the invention are respectively shown. More specifically, FIGS. 4B and 4C show a terminal portion of the heat exchanger 1. The heat exchanger 1 of FIG. 4B is essentially identical to the one shown in FIG. 3B, except for the assembly wall 35 which comprises a further third assembly element 17. This third assembly element 17 is installed in between the first assembly element 15 and the second assembly element 16. Preferably, the third assembly element 17 is an intermediate tube concentrically arranged with respect to the inner tube 3 and the outer tube 2. Preferably, the first end 8 of the outer tube 2 is adjacent to the first end 22 of the third assembly element 17. The first end 8 of the outer tube 2 is jointed to the first end 22 of the third assembly element 17 by means of the first assembly element 15. The second end 20 of the third assembly element 17 is jointed to the second assembly element 16, which is integrally formed with the third tube section 36 of the inner tube 3.

The heat exchanger 1 of FIG. 4C is essentially identical to the one shown in FIG. 3C, except for the assembly wall 35 which comprises a further third assembly element 17. This third assembly element 17 is installed in between the first assembly element 15 and the second assembly element 16. Preferably, the third assembly element 17 is an intermediate tube concentrically arranged with respect to the inner tube 3 and the outer tube 2. Preferably, the first end 8 of the outer tube 2 is adjacent to the first end 22 of the third assembly element 17. The first end 8 of the outer tube 2 is jointed to the first end 22 of the of the third assembly element 17 by means of the first assembly element 15. The second end 20 of the third assembly element 17 is jointed to the second assembly element 16, which is integrally formed with the second tube section 25 of the inner tube 3.

Figure 5:
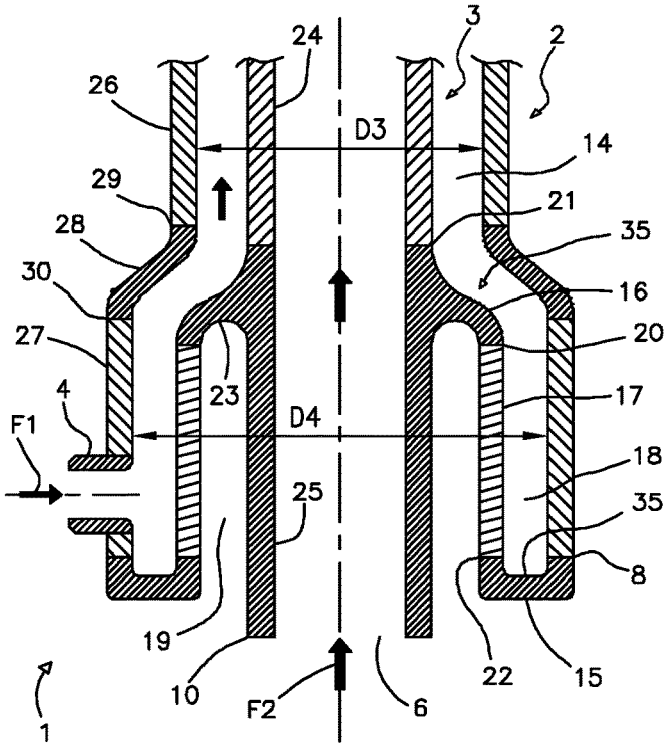
FIG. 5 is a partial and sectional longitudinal view of a seventh embodiment of the double-tube heat exchanger according to the invention.

With reference to FIG. 5, a seventh embodiment of the double-tube heat exchanger 1 according to the invention is shown. More specifically, FIG. 5 shows a terminal portion of the heat exchanger 1. The heat exchanger 1 of FIG. 5 can essentially correspond to any of the aforementioned embodiments, from the first to the sixth, except for the outer tube 2 which comprises two or more tube sections, for example a first tube section 26 and a second tube section 27, jointed by means of a fourth assembly element 28. The first tube section 26 and the second tube section 27 have respective internal diameters D3 and D4 which can be different each other. According to an advantageous configuration, the internal diameter D4 of the second tube section 27 is larger than the internal diameter D3 of the first tube section 26. A first end 29 of the first tube section 26 is jointed to the fourth assembly element 28, whereas the other end (not shown) of the first tube section 26 is located towards the second end 9 of the outer tube 2. An end 30 of the second tube section 27 is jointed to the fourth assembly element 28, whereas the other end of the second tube section 27 corresponds to the first end 8 of the outer tube 2. Preferably, the fourth assembly element 28 is installed near the junction 21 related to the inner tube 3. The fourth assembly element 28 is preferably a cone, or a pseudo-cone, or an element of "Z" profile, and can have the important function to increase the structural flexibility of the heat exchanger 1.

Figure 6:
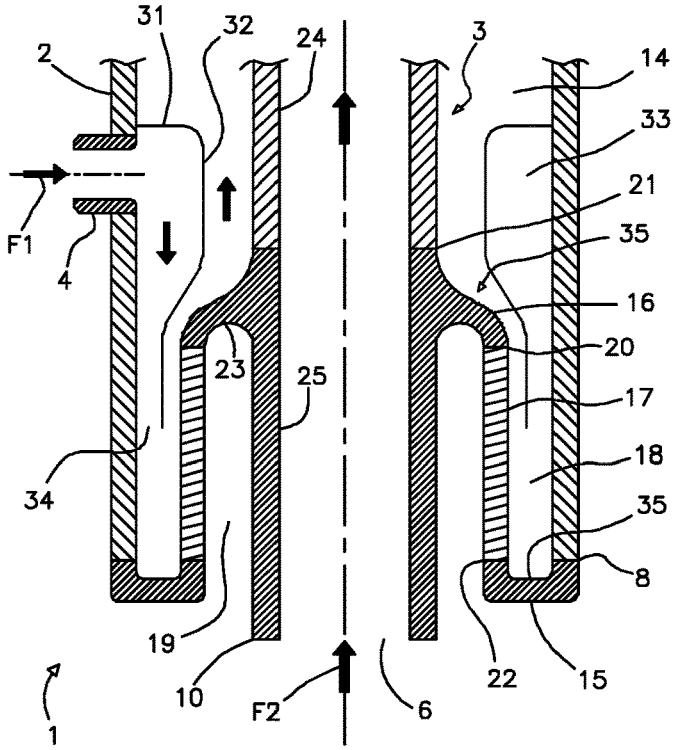
FIG. 6 is a partial and sectional longitudinal view of an eighth embodiment of the double-tube heat exchanger according to the invention.

With reference to FIG. 6, an eighth embodiment of the double-tube heat exchanger 1 according to the invention is shown. More specifically, FIG. 6 shows a terminal portion of the heat exchanger 1. The heat exchanger 1 of FIG. 6 can essentially correspond to any of the aforementioned embodiments, from the first to the seventh, except for the first annulus 14 wherein a partition 32, or a fluid conveyor, is installed so as to form a third gap 33 in between the outer tube 2 and the fluid conveyor 32. This third gap 33, at a first end 31 of the fluid conveyor 32, is sealed and is in fluid communication only with the inlet connection 4 of the outer tube 2. At the second end 34 of the fluid conveyor 32, the third gap 33 is instead in fluid communication with the first annulus 14. The second end 34 of the fluid conveyor 32, which is in fluid communication with the first annulus 14, is placed next to either the junction 21 related to the inner tube 3 or in the portion of the first annulus 14 which corresponds to the additional annulus 18. The inlet connection 4 is preferably located at some distance from the additional annulus 18. Preferably, the fluid conveyor 32 is a tube concentrically arranged with respect to the outer tube 2. The fluid conveyor 32 preferably forms a third gap 33 with annular geometry.

Figure 7A:
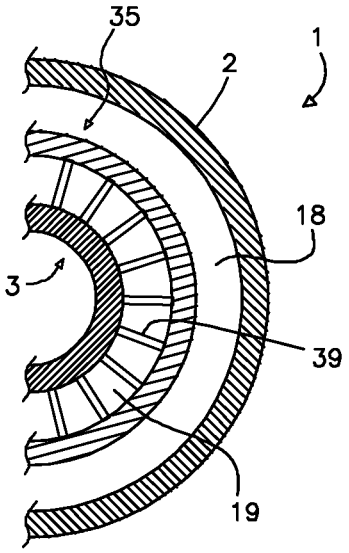
FIGS. 7A, 7B and 7C are a partial view, according to lines X-X' and Y-Y' of FIG. 4C, of a ninth embodiment of the double-tube heat exchanger according to the invention.
Figure 7B:
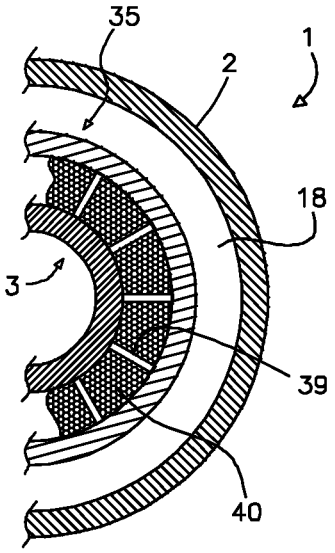
Figure 7C:
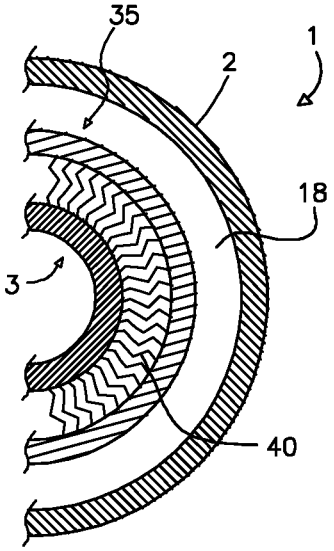

With reference to FIGS. 7A, 7B and 7C, a ninth embodiment of the double-tube heat exchanger 1 according to the invention is shown. More specifically, FIGS. 7A, 7B and 7C show a transversal (X-X') and a longitudinal (Y-Y') section of the heat exchanger 1 shown in FIG. 4C. The heat exchanger 1 of FIGS. 7A, 7B and 7C can essentially correspond to any of the aforementioned embodiments, from the first to the eighth, except for the second annulus 19 exposed to the air wherein elements and/or materials are installed. Such elements and/or materials installed in the second annulus 19 have the purpose of transferring heat between the inner tube 3, or the upstream 100 and the downstream 200 equipment, or the inner tube 3 and the upstream 100 or the downstream 200 equipment, and the assembly wall 35. Since such elements and/or materials must be suitable to heat transfer, they must be characterized by an adequate thermal conductivity. Specifically, FIG. 7A shows heat transfer elements 39 that can comprise fins, spokes, bars, chips, or similar, FIG. 7B shows heat transfer elements 39 surrounded by or embedded in a heat transfer filling material 40, and FIG. 7C shows a filling heat transfer material 40. The heat transfer filling material 40 can be dense or porous, metallic or non-metallic, or any respective combination. The heat transfer elements 39 and the heat transfer filling material 40 can be, alternatively, sponge, mesh, corrugated or thin sheets metallic items.

Figure 8A:
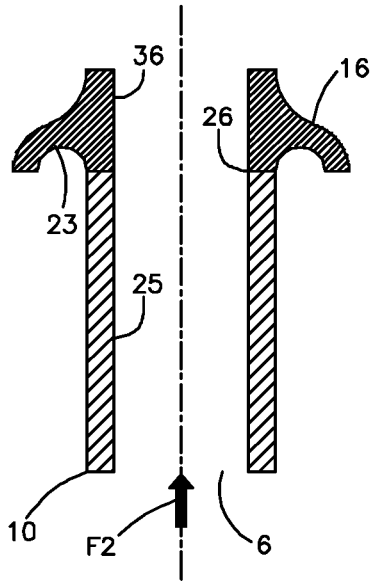
FIGS. 8A-8F are partial and sectional views showing in sequence a first manufacturing method of the double-tube heat exchanger according to the invention.
Figure 8B:
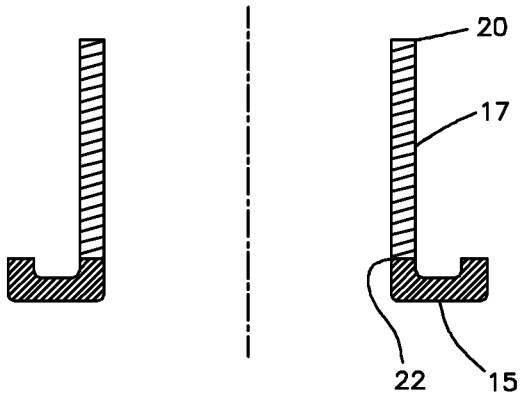
Figure 8C:
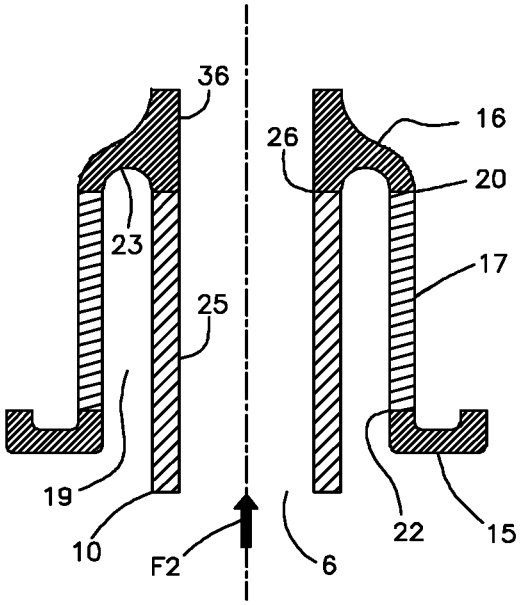
Figure 8D:
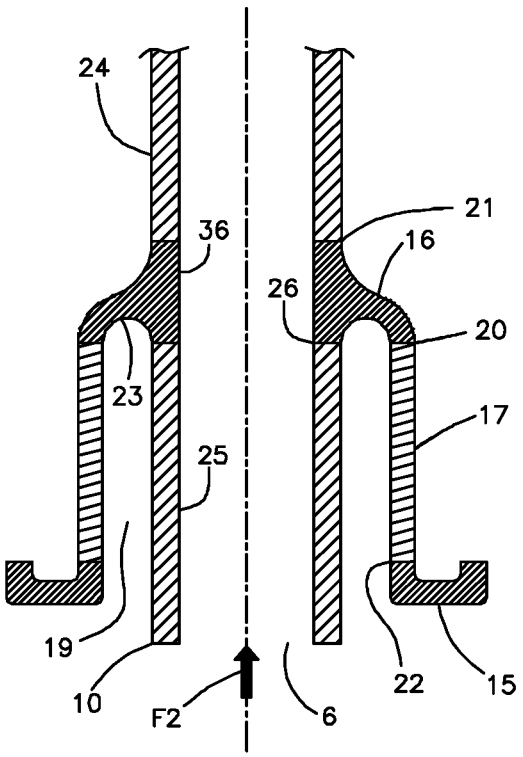
Figure 8E:
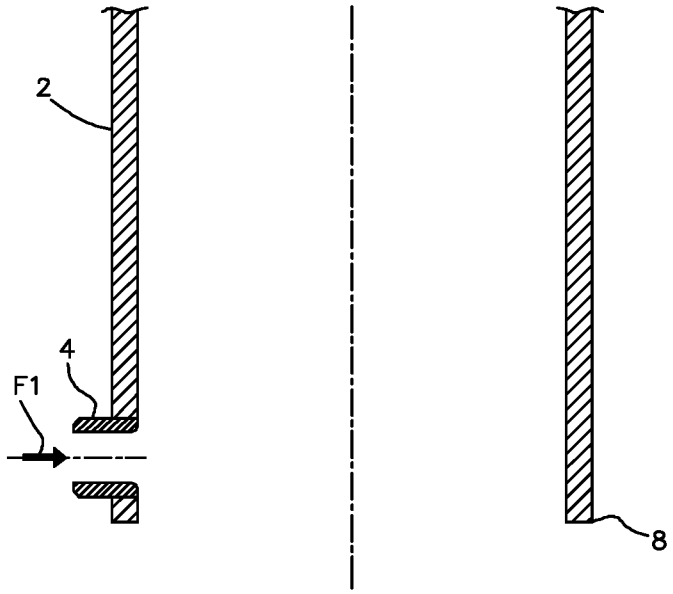
Figure 8F:
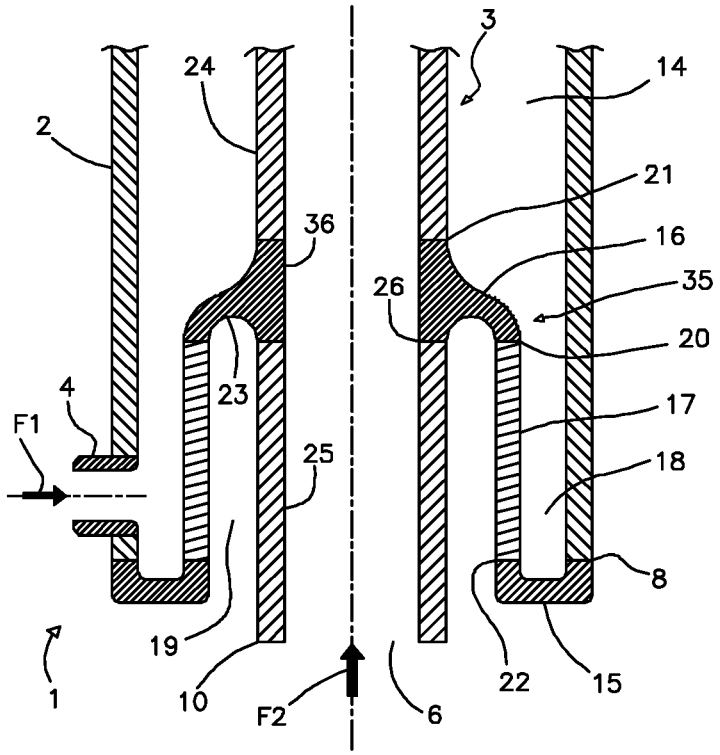

With reference to FIGS. 8A-8F, sequential steps of a first manufacturing method of the double-tube heat exchanger 1 according to the invention are shown. More specifically, FIGS. 8A-8F show the manufacturing steps of a double-tube heat exchanger 1 as described in FIG. 4B. FIGS. 8A-8F show a terminal portion of the heat exchanger 1. In accordance with such a first manufacturing method, the heat exchanger 1 of FIG. 4B can be manufactured thru the following steps:

a) the third tube section 36 of the inner tube 3, integrally formed with the second assembly element 16, is welded to the second tube section 25 of the inner tube 3, forming a first part of the heat exchanger 1 (FIG. 8A);
b) the first assembly element 15 is welded to the third assembly element 17 (intermediate tube), forming a second part of the heat exchanger 1 (FIG. 8B);
c) the second part of FIG. 8B is welded to the first part of FIG. 8A by means of the second assembly element 16, forming a third part of the heat exchanger 1 (FIG. 8C);
d) the first tube section 24 of the inner tube 3 is welded to the third part of FIG. 8C by means of the third tube section 36 of the inner tube 3, forming a fourth part of the heat exchanger 1 (FIG. 8D);
e) the inlet connection 4 of the outer tube 2 is welded to the outer tube 2, forming a fifth part of the heat exchanger 1 (FIG. 8E);
f) the fifth part of FIG. 8E is welded to the fourth part of FIG. 8D by means of the first assembly element 15, forming a sixth part (FIG. 8F) which corresponds to the entire terminal portion of the double-tube heat exchanger 1 according to the invention.

The manufacturing steps from a) to f) represent, therefore, a manufacturing method of the double-tube heat exchanger 1 according to the invention, and specifically of the heat exchanger 1 according the FIG. 4B. The aforementioned manufacturing steps sequence can be, anyway, different, without substantially changing the manufacturing method of the heat exchanger 1 as per FIG. 4B. In case the inlet connection 4 of the outer tube 2 is installed on the first assembly element 15, or on the first assembly element 15 and on the outer tube 2, the step e) could be eliminated. The welding of the inlet connection 4 of the outer tube 2 could be, therefore, included in the step b), else be executed in a step g) following the step f).

With reference to FIGS. 9A-9E, sequential steps of a second manufacturing method of the double-tube heat exchanger 1 according to the invention are shown.

Figure 9A:
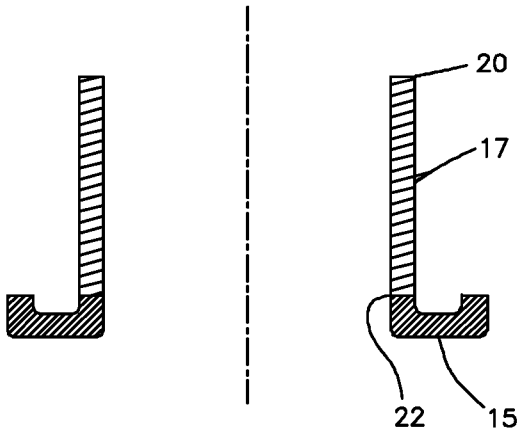
FIGS. 9A-9E are partial and sectional views showing in sequence a second manufacturing method of the double-tube heat exchanger according to the invention.
Figure 9B:
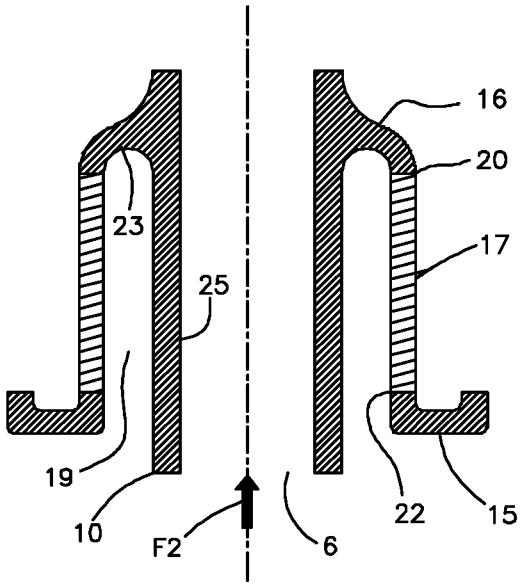
Figure 9C:
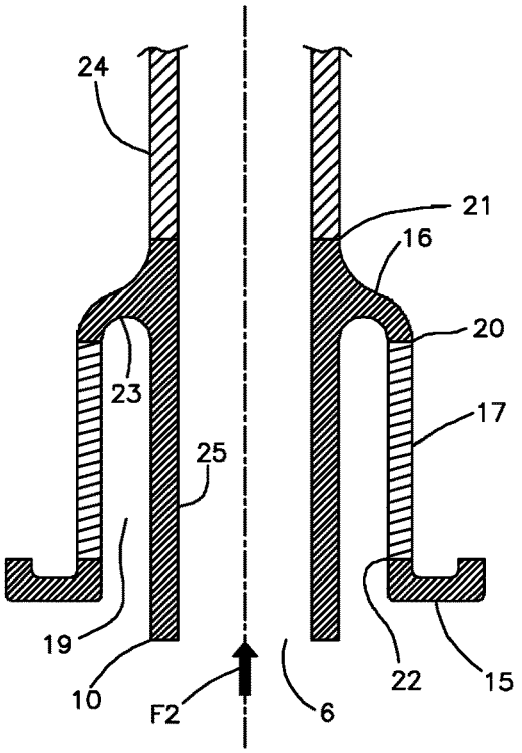
Figure 9D:
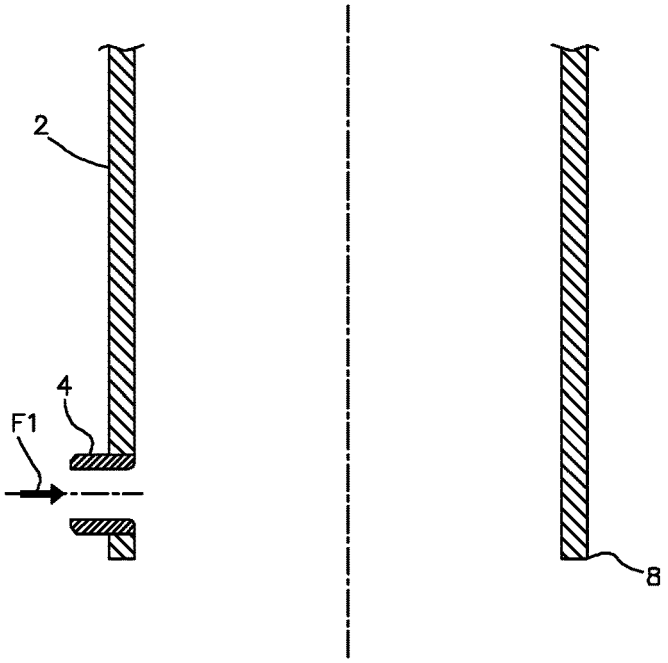
Figure 9E:
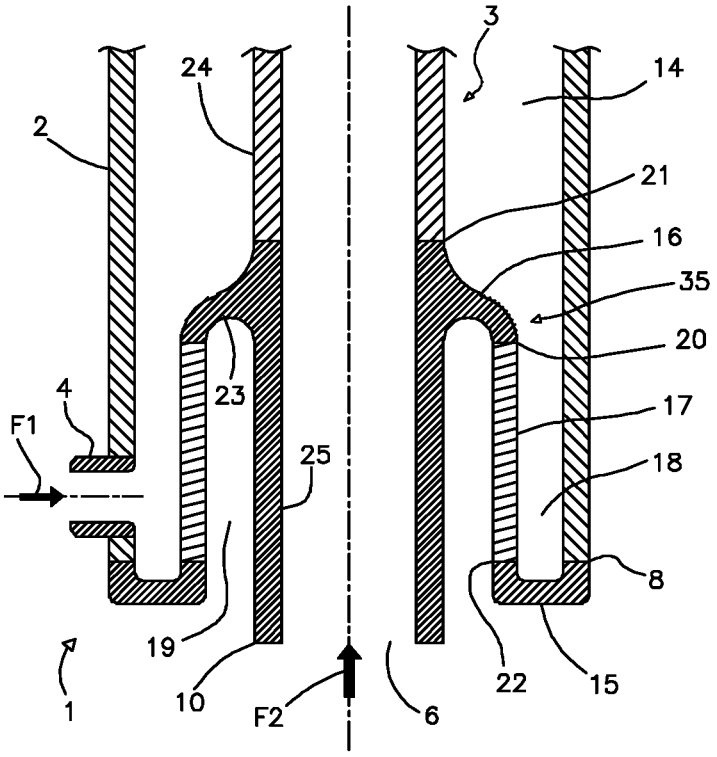

More specifically, FIGS. 9A-9E show the manufacturing steps of a double-tube heat exchanger 1 as described in FIG. 4C. FIGS. 9A-9E show a terminal portion of the heat exchanger 1. In accordance with such a second manufacturing method, the heat exchanger 1 of FIG. 4C can be manufactured thru the following steps:

a) the first assembly element 15 is welded to the third assembly element 17 (intermediate tube), forming a first part of the heat exchanger 1 (FIG. 8A);
b) the first part of FIG. 9A is welded to the second tube section 25 of the inner tube 3 by means of the second assembly element 16, forming a second part of the heat exchanger 1 (FIG. 9B);
c) the first tube section 24 of the inner tube 3 is welded to the second part of FIG. 9B by means of the second tube section 25 of the inner tube 3, forming a third part of the heat exchanger 1 (FIG. 9C);
d) the inlet connection 4 of the outer tube 2 is welded to the outer tube 2, forming a fourth part of the heat exchanger 1 (FIG. 9D);
e) the fourth part of FIG. 9D is welded to the third part of FIG. 9C by means of the first assembly element 15, forming a fifth part (FIG. 9E) which corresponds to the entire terminal portion of the double-tube heat exchanger 1 according to the invention.

The manufacturing steps from a) to e) represent, therefore, a manufacturing method of the double-tube heat exchanger 1 according to the invention, and specifically of the heat exchanger 1 according the FIG. 4C. The aforementioned manufacturing steps sequence can be, anyway, different, without substantially changing the manufacturing method of the heat exchanger 1 as per FIG. 4C. In case the inlet connection 4 of the outer tube 2 is installed on the first assembly element 15, or on the first assembly element 15 and on the outer tube 2, the step d) could be eliminated. The welding of the inlet connection 4 of the outer tube 2 could be, therefore, included in the step a), else be executed in a step f) following the step e).

According to the embodiments of the heat exchanger 1 of FIGS. 2B-2C, 3B-3C, 4B-4C, 5 and 6, the first fluid F1, which flows in the first annulus 14, and the second fluid F2, which flows in the inner tube 3, exchange heat in between them by means of an indirect contact. The two fluids F1 and F2 exchange the greater amount of the heat thru the wall of the inner tube 3 which is in contact with the first fluid F1. Conversely, a part of the heat is exchanged between the two fluids F1 and F2 thru the second annulus 19. The heat transfer mechanism thru the wall of the inner tube 3, which is in contact with the first fluid F1, is predominantly based on the convection of the fluids F1 and F2. On the contrary, the heat transfer thru the second annulus 19, and therefore not thru the wall of the inner tube 3 in contact with the first fluid F1, is essentially based on the thermal conduction and/or convection of the air, and/or the thermal conduction of the elements 39, and/or the thermal conduction of the filling material 40, and/or the thermal radiation.

According to an advantageous configuration of the heat exchanger 1, the first fluid F1 is the colder fluid and the second fluid F2 is the hotter fluid. The first fluid F1 is therefore the cooling fluid and it receives the heat from the second fluid F2. Generally, as per FIG. 1, the first fluid F1 and the second fluid F2 exchange heat by a co-current configuration when the inlet connection 4 of the outer tube 2 is closer to the inlet connection 6 of the inner tube 3 than the outlet connection 5 of the outer tube 2 is to the inlet connection 6 of the inner tube 3. Else, the first fluid F1 and the second fluid F2 exchange heat by a counter-current configuration.

In accordance to the embodiments of the heat exchanger 1 of FIGS. 2B-2C, 3B-3C, 4B-4C and 5, the first fluid F1 is injected into the heat exchanger 1 thru the inlet connection 4 of the outer tube 2, whereas the second fluid F2 is injected into the heat exchanger 1 thru the inlet connection 6 of the inner tube 3. Preferably, the first fluid F1 is injected into the first annulus 14 at the additional annulus 18. Thus, the first fluid F1 first flows in the additional annulus 18 and then in the remaining portion of the first annulus 14, towards the outlet connection 5 of the outer tube 2. The second fluid F2 flows along the inner tube 3, towards the outlet connection 7 of the inner tube 3. The first fluid F1 and the second fluid F2 exchange heat by a co-current configuration.

According to another configuration, the connection 4 of the outer tube 2 shown in FIGS. 2B-2C, 3B-3C, 4B-4C and 5 corresponds to the outlet connection of the first fluid F1. In this case, the flow direction of the first fluid F1 is opposite compared to the one shown in FIGS. 2B-2C, 3B-3C, 4B-4C and 5. The first fluid F1 is injected thru an inlet connection (not shown) of the outer tube 2, it flows in the first annulus 14 and then in the portion of the first annulus 14 which corresponds to the additional annulus 18, towards an outlet connection of the outer tube 2.

With reference to FIG. 6, the first fluid F1 is injected into the heat exchanger 1 at the first end 31 of the fluid conveyor 32. Such a fluid conveyor 32 collects the first fluid F1 from the inlet connection 4 of the outer tube 2 and carries the first fluid F1 in the third gap 33 towards the portion of the first annulus 14 which corresponds to the additional annulus 18. The first fluid F1 exits the third gap 33 thru the respective open end 34 and start to flow in the portion of the first annulus 14 which corresponds to the additional annulus 18. The first fluid F1 therefore flows in the remaining part of the first annulus 14, towards the outlet connection 5 of the outer tube 2.

According to another configuration, the connection 4 of the outer tube 2 shown in FIG. 6 corresponds to the outlet connection of the first fluid F1. In this case, the flow direction of the first fluid F1 is opposite compared to the one shown in FIG. 6. The first fluid F1 is injected thru an inlet connection (not shown) of the outer tube 2, it flows in the first annulus 14 and then in the portion of the first annulus 14 which corresponds to the additional annulus 18. The first fluid F1 then enters the third gap 33 thru the respective open end 34 and it flows towards the outlet connection 4 of the outer tube 2.

According to another advantageous configuration, the first fluid F1 is water at high pressure and in boiling conditions, whereas the second fluid F2 is a hot process fluid discharged from a chemical reactor. If the chemical reactor is a hydrocarbons steam cracking furnace for olefins production, the process fluid is a cracked gas, and the double-tube heat exchanger 1 is a quencher for the cracked gas with, preferably, a vertical layout and, preferably, the inlet connection 6 of the cracked gas installed in the bottom terminal portion. The cracked gas enters the inner tube 3, thru the inlet connection 6, at a temperature and pressure of approx. 800-850° C. and 150-250 kPa(a), respectively. The cracked gas enters at a velocity which is usually higher than 90 m/s and it is laden of carbonaceous and waxy particulate. Along the inner tube 3, the cracked gas exchanges heat, by indirect contact, with the boiling water and therefore the cracked gas cools down. The cooling is rapid (a fraction of second) thanks to the high heat transfer coefficients on water- and gas-side. Approximately, such coefficients are in the range of 500 $W/m^{2\circ}$ C. for the cracked gas and 20000 $W/m^{2\circ}$ C. for the boiling water. During the quenching, the cracked gas deposits a significant amount of carbonaceous and waxy fouling on the inner tube 3. Such a deposit can lead to a shutdown of the unit and to a subsequent chemical or mechanical cleaning. The boiling water flows in the first annulus 14 from bottom to top, removing the heat from the assembly wall 35 and the inner tube 3 and exchanging heat with the cracked gas according to a co-current configuration. The outer tube 2 is jointed, by means of piping, to a steam drum (not shown in figures) placed at an elevated position. The water-steam mixture produced in the quencher moves-up towards the steam drum. The water-steam mixture is replaced by water coming from the steam drum. The circulation between the quencher and the steam drum is of natural draft type and is driven by the density difference between the rising mixture and the downward water. With reference to FIGS. 2B-2C, 3B-3C, 4B-4C and 5, the water in injected into the quencher thru the inlet connection 4, installed at the additional annulus 18. The water, in boiling or incipient boiling conditions, flows in the additional annulus 18 and then along the remaining portion of the first annulus 14. With reference to FIG. 6, the water is injected into the quencher thru the connection 4, which is preferably at some distance from the additional annulus 18. In this last case, the water is conveyed downward by the fluid conveyor 32. At the open end 34 of the fluid conveyor 32, the water exits the third gap 33 and enters the portion of the first annulus 14 which corresponds to the additional annulus 18, and then it flows upward, exchanging heat with the cracked gas, towards the outlet connection (not shown). Since the water flowing in the first annulus 14 is in boiling conditions, or in incipient boiling conditions, and its temperature is substantially identical to the temperature of the water flowing in the third gap 33, the water that flows in the third gap 33 does not boil, or marginally boils, Consequently, the natural circulation of the water is not affected by the water flow in the third gap 33.

FIGS. 2B-2C, 3B-3C, 4B-4C, 5 and 6 show advantageous technological solutions since the outer tube 2 and the inner tube 3 can be each other jointed by means of an assembly wall 35 of high quality, and since the welding joints associated to the inner tube 3 can be accurately examined and can guarantee, at high pressures and metal temperatures, proper sealing, absence of crevice corrosion, durable reliability. Moreover, the technological solutions according to FIGS. 3B, 3C, 4B and 4C result to be advantageous since the assembly wall 35 can be manufactured with two elements 15 and 16, also of different material, which can be welded together by a butt-to-butt welding joint. Solutions according to FIGS. 4B and 4C are, besides, advantageous since the portion of the first annulus 14 which corresponds to the additional annulus 18 can be easily extended, as needed, for directing and well developing the first fluid F1 along the additional annulus 18. Therefore, the first fluid F1 can efficiently flow around the junction 21 related to the inner tube 3 by a uniform and longitudinal fluid stream. FIGS. 5 and 6 show further advantageous technological solutions since both the fourth assembly element 28 and both the fluid conveyor 32 can have a shape so as to force the first fluid F1 to flow, at high velocity and with uniform fluid stream, around the junction 21 related to the inner tube 3.

In accordance with another advantageous configuration of the double-tube heat exchanger 1, the heat transfer elements 39 or the heat transfer filling materials 40, shown in FIGS. 7A, 7B, and 7C, consist of metal thin sheets or fins, and/or of metal meshes or sponges, inserted into the second annulus 19 and in contact with, or compressed against, the walls of the parts delimiting the second annulus 19. Such sheets, fins, meshes or sponges enhance the heat transfer between the inner tube 3, or the upstream 100 or the downstream 200 equipment/conduits, or the inner tube 3 and the upstream 100 or the downstream 200 equipment/conduits, and the assembly wall 35, and make more uniform the temperature distribution in the walls delimiting the second annulus 19. As a result, the heat transfer elements 39 or the heat transfer filling materials 40 attenuate the thermal gradients and the thermal-mechanical stresses in the walls delimiting the second annulus 19 exposed to the air.

In summary, the innovative double-tube heat exchanger 1 according to the aforementioned embodiments and description has the following advantages:

- the first fluid F1 has essentially a high, uniform and longitudinal velocity around the assembly wall 35, especially near the junction 21 of the inner tube 3. In case of a vertically arranged quencher for the cracked gas, the boiling water flows at high velocity around the assembly wall 35, especially near the junction 21 of the inner tube 3, moving upward by a well-developed fluid stream. As a result, cooling and steam removal action on the hottest surfaces is uniform and efficient: there are no stagnant, recirculation, low-velocity zones around the assembly wall 35 near the junction 21. Steam engulfment and/or steam blanketing are no more possible. Such a thermal-fluid-dynamics is of topmost importance since the assembly wall 35 works at high metal temperatures and is subject to large heat fluxes;
- in case the double-tube heat exchanger 1 is a cracked gas quencher in vertical position, salts and impurities deposits on water-side hardly occur on the assembly wall 35 near the junction 21 of the inner tube 3. In fact, the assembly wall 35, near the junction 21 of the inner tube 3, has a continuous slope and, especially, does not form the bottom for first annulus 14. Moreover, the imposed high-velocity water flow has a strong cleaning action. Water-side deposits may occur on the bottom of the first annulus 14, that is on the bottom of the portion of the first annulus 14 which corresponds to the additional annulus 18, therefore far from the hottest surfaces. On the bottom of the first annulus 14, a blowdown connection (not shown in figures) can be installed for once-for-all removing possible deposits. As a result, risk of water-side corrosion and overheating is efficaciously reduced or eliminated;
- the "U" shape of the terminal portion 23 of the second annulus 19, facing the second annulus 19, helps to attenuate the thermal-mechanical stresses. Also, the assembly wall 35 has preferably a curvilinear profile near the junction 21 of the inner tube 3, on the side of the first annulus 14, which cooperates in the attenuation of the tensional status of the parts. Thus, from a general standpoint, the assembly wall 35 acts like an expansion bellow: it introduces a structural flexibility in radial and longitudinal direction. The assembly wall 35 can efficiently absorb the differential thermal elongations between the inner tube 3 and the outer tube 2. Such flexibility and attenuation actions are of utmost importance since, at high pressures and temperatures, the thermal-mechanical stresses in the pressure parts can be high;
- the inlet connection 4 of the outer tube 2 has a negligible mechanical effect on the inner tube 3 or on the junction 21 and/or 26 of the inner tube 3. This makes easier the design since the thermal-mechanical stresses of the inner tube 3 are independent from the inlet or outlet connections of the outer tube 2;
- the impingement of the first fluid F1 on the inner tube 3 and on the junction 21 of the inner tube 3 is prevented, since the inlet connection 4 of the outer tube 2 can be placed at some distance. This reduces the risk of erosion and thermal shock on hottest pressure parts;
- the heat transfer between the two fluids F1 and F2 thru the second annulus 19 can prove to be significantly advantageous, since the temperature distribution and the thermal gradients in the assembly wall 35 and in the inner tube 3 are uniformized and attenuated. Depending on the operating conditions, larger the heat transfer, smaller the thermal-mechanical stresses in the assembly wall 35 and in the tube section 36, 25 integrally formed with the assembly wall 35;
- embodiments and manufacturing methods of the double-tube heat exchanger 1, described respectively in FIGS. 2B-2C, 3B-3C, 4B-4C, 5, 6 and in FIGS. 8A-8F and 9A-9E, allows to obtain a heat exchanger 1 of high quality, suitable for high pressure and high temperature services. All the welding joints associated to the inner tube 3 are of butt-to-butt type and of full penetration type, and therefore the welding joints can be examined by radiographic and/or ultrasonic testing. The portion of the heat exchanger 1 formed by the assembly wall 35 and the tube section 36, 25 of the inner tube 3, integrally formed with the assembly wall 35, is made by forging or casting, therefore chemical/mechanical properties are uniform and there is no risk of crevice corrosion or welding defects.

As per above, the double-tube heat exchanger 1 according to the present invention achieves the aforementioned objects. The double-tube heat exchanger 1 as described in the present invention is in any case susceptible of numerous modifications and variants, all falling under the same inventive concept; moreover, all the related details can be replaced by technically equivalent elements. Practically, all the described materials, along with the shapes and dimensions, can be any depending on the technical requirements. The scope of protection of the invention is therefore defined by the attached claims.

The invention claimed is:

1. A double-tube heat exchanger (1) comprising an outer tube (2) and an inner tube (3) concentrically arranged so as to form a first annular gap (14) in between said outer tube (2) and said inner tube (3), wherein said outer tube (2) is provided with at least an inlet connection (4) and with at least an outlet connection (5) for inletting and outletting, respectively, a first fluid (F1) flowing in said first annular gap (14), wherein said inner tube (3) is provided with at least an inlet connection (6) and with at least an outlet connection (7) for inletting and outletting, respectively, a second fluid (F2) flowing in said inner tube (3) for an indirect heat exchange with the first fluid (F1), wherein said inlet (6) and outlet (7) connections of the inner tube (3) are jointed to equipment or conduits placed upstream (100) and/or downstream (200) of the heat exchanger (1), and wherein at least an assembly wall (35) joints a first end (8) of said outer tube (2) to said inner tube (3) so as to seal said first annular gap (14) at the first end (8) of said outer tube (2), said heat exchanger (1) being characterized in that said inner tube (3) is formed by at least two tube sections (24, 25, 36), jointed each other by means of a joint of butt-to-butt type, wherein at least one (25, 36) of said tube sections is integrally formed, as a single monolithic piece, with said assembly wall (35), wherein a second annular gap (19) is formed in between said assembly wall (35) and said inner tube (3), or formed between said assembly wall (35) and said equipment, or formed between said assembly wall (35) and said inner tube (3) and said equipment, wherein said second annular gap (19) is exposed to the air and is in fluid communication neither with said first annular gap (14) nor with said inner tube (3), and wherein said second annular gap (19) is at least partially surrounded by said first annular gap (14); wherein one or more heat transfer elements (39) or heat transfer filling materials (40) are inserted into said second annular gap (19), wherein said heat transfer elements (39) or said heat transfer filling materials (40) are configured for enhancing the heat transfer by passing heat through the heat transfer elements or heat transfer filling materials and between said assembly wall (35) and said inner tube (3), or between said assembly wall (35) and said equipment, or between said assembly wall (35) and said inner tube (3) and said equipment.

2. The double-tube heat exchanger (1) according to claim 1, characterized in that a third tube section (36) of the inner tube (3), integrally formed with said assembly wall (35), is installed in between a first tube section (24) and a second tube section (25) of the inner tube (3), wherein said first tube section (24) is jointed, at one end (21) thereof, to the third tube section (36), and wherein said second tube section (25) is jointed, at one end (26) thereof, to the third tube section (36).

3. The double-tube heat exchanger (1) according to claim 1, characterized in that said assembly wall (35) comprises a first assembly element (15) and a second assembly element (16) reciprocally jointed by means of an intermediate junction (37), wherein the first assembly element (15) is jointed to the first end (8) of said outer tube (2), and wherein the second assembly element (16) is integrally formed with at least one of said tube sections (25, 36) of said inner tube (3).

4. The double-tube heat exchanger (1) according to claim 3, characterized in that said assembly wall (35) comprises a further third assembly element (17), wherein said third assembly element (17) is installed at said intermediate junction (37) in between the first assembly element (15) and the second assembly element (16), so that a first end (22) of the third assembly element (17) is jointed to the first assembly element (15) and the second end (20) of the third assembly element (17) is jointed to the second assembly element (16).

5. The double-tube heat exchanger (1) according to claim 4, characterized in that said third assembly element (17) is a tube concentrically arranged with respect to said inner tube (3) and said outer tube (2).

6. The double-tube heat exchanger (1) according to claim 1, characterized in that said inlet connection (4) or said outlet connection (5) of the outer tube (2) is installed at the second annular gap (19).

7. The double-tube heat exchanger (1) according to claim 1, characterized in that a fluid conveyor (32) is installed in the first annular gap (14), wherein said fluid conveyor (32) forms a third gap (33) with said outer tube (2), wherein said third gap (33), at a first end (31) thereof, is in fluid communication with said inlet connection (4) or said outlet connection (5) of the outer tube (2) and is not in direct fluid communication with said first annular gap (14), and wherein said third gap (33), at a second end (34) thereof, is in fluid communication with the first annular gap (14).

8. The double-tube heat exchanger (1) according to any claim 1, characterized in that said inner tube (3) has at least two internal diameters (D1, D2), different each other.

9. The double-tube heat exchanger (1) according to claim 1, characterized in that said outer tube (2) comprises at least a fourth tube section (26), a fifth tube section (27) and a fourth assembly element (28), wherein said fourth assembly element (28) is installed in between the fourth tube section (26) and the fifth tube section (27) so that said fourth assembly element (28), at a first end (29) thereof, is jointed to an end of the fourth tube section (26) and, at the other end (30) thereof, is jointed to an end of the fifth tube section (27), and wherein the internal diameter of the fourth tube section (26) is different than the internal diameter of the fifth tube section (27).

10. The double-tube heat exchanger (1) according to claim 1, characterized in that said tube section (25, 36) integrally formed with said assembly wall (35), or with said second assembly element (16), is a piece made by forging or casting.

11. The double-tube heat exchanger (1) according to claim 1, characterized in that the terminal portion (23) of the second annular gap (19), delimited by the assembly wall (35), is provided with a convex or "U" shape facing the second annular gap (19).

12. The double-tube heat exchanger (1) according to claim 1, characterized in that said assembly wall (35), on the first annular gap (14) side and adjacently the inner tube (3), is provided with a curvilinear profile and a continuous slope.

13. The double-tube heat exchanger (1) according to claim 1, characterized in that said first fluid (F1) is cooling water in boiling conditions, said second fluid (F2) is a hot process gas, and said heat exchanger (1) is a quencher installed in a hydrocarbons steam cracking furnace for producing olefins.

* * * * *